US005379012A

United States Patent [19]

Shimizu et al.

[11] Patent Number: 5,379,012

[45] Date of Patent: Jan. 3, 1995

[54] DIELECTRIC FILTER DEVICE

[75] Inventors: Hiroyuki Shimizu; Kenji Ito, both of Nagoya, Japan

[73] Assignee: NGK Spark Plug Co., Ltd., Aichi, Japan

[21] Appl. No.: 51,766

[22] Filed: Apr. 26, 1993

[30] Foreign Application Priority Data

| | | | |
|---|---|---|---|
| Apr. 30, 1992 | [JP] | Japan | 4-139863 |
| May 7, 1992 | [JP] | Japan | 4-143259 |
| May 22, 1992 | [JP] | Japan | 4-155930 |

[51] Int. Cl.[6] ..... H01P 1/205

[52] U.S. Cl. ..... 333/206; 333/222

[58] Field of Search ..... 333/202, 206, 207, 235, 333/222, 223, 246

[56] References Cited

U.S. PATENT DOCUMENTS

| | | | |
|---|---|---|---|
| 4,703,291 | 10/1987 | Nishikawa et al. | 333/202 |
| 4,987,393 | 1/1991 | Yorita et al. | 333/202 |
| 5,196,813 | 3/1993 | Nakakubo | 333/206 |
| 5,239,280 | 8/1993 | Noguchi et al. | 333/206 |

FOREIGN PATENT DOCUMENTS

| | | | |
|---|---|---|---|
| 0156903 | 7/1986 | Japan | 333/206 |
| 0237501 | 10/1986 | Japan | 333/202 |
| 0077702 | 4/1987 | Japan | 333/202 |
| 0179002 | 7/1990 | Japan | 333/202 |
| 0108801 | 5/1991 | Japan | 333/206 |

OTHER PUBLICATIONS

Patent Abstracts of Japan, vol. 9, No. 193, 9 Aug. 1985, JP-A-60-62202 (Apr., 1985).

Patent Abstracts of Japan, vol. 14, No. 560, 13 Dec. 1990, JP-A-2-241202 (Sep. 1990).

Patent Abstracts of Japan, vol. 12, No. 111, 8 Apr. 1988, JP-A-62-241402 (Oct. 1987).

Patent Abstracts of Japan, vol. 11, No. 277, 8 Sep. 1987, JP-A-62-77702 (Apr. 1, 1987).

Patent Abstracts of Japan, vol. 16, No. 130, 2 Apr. 1992, JP-A-3-292002 (Dec. 1991).

Patent Abstracts of Japan, vol. 13, No. 518, 20 Nov. 1989, JP-A-1-209801 (Aug. 1989).

*Primary Examiner*—Seungsook Ham

*Attorney, Agent, or Firm*—Larson & Taylor

[57] ABSTRACT

A dielectric filter device including at least two dielectric resonator bodies juxtaposed to each other each provided with a through bore which has an inner conductive layer, a first dielectric substrate provided with electrodes on its surfaces for forming input and output capacities and a second dielectric substrate provided with capacitively coupled electrodes on its inner surfaces for forming a coupling capacity and an electrode which cooperates with the capacitively coupled electrodes to form stray capacities, the first and second dielectric substrates being superimposed and mounted on the front surfaces of the juxtaposed dielectric resonator bodies. Each dielectric resonator body comprises two longitudinally divided halves, and the inner surface of one of the halves which form the outermost resonator body is provided with conductive connecting lines each of which has one end connected with the inner conductive layer in the through bore and the other end connected with an input or output terminal provided on the lateral surface of the associated resonator body.

4 Claims, 8 Drawing Sheets

FIG. 2A
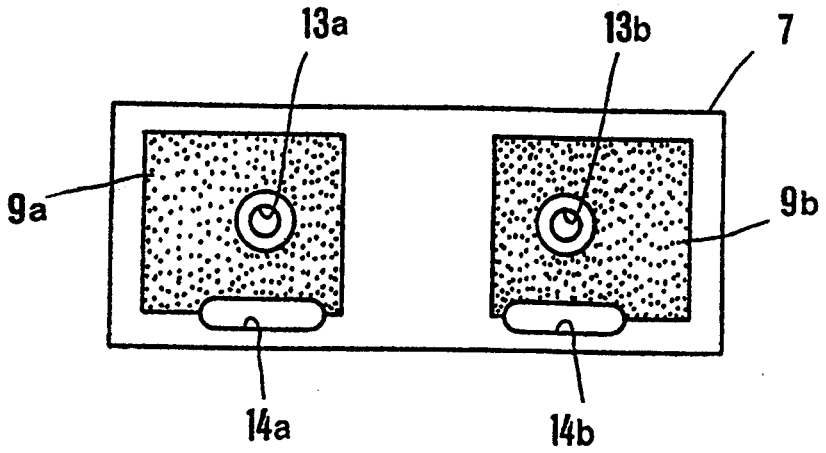
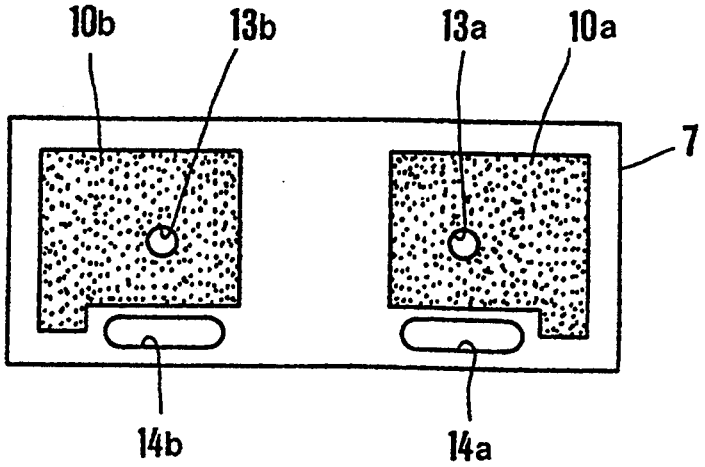
FIG. 2B

FIG. 3A
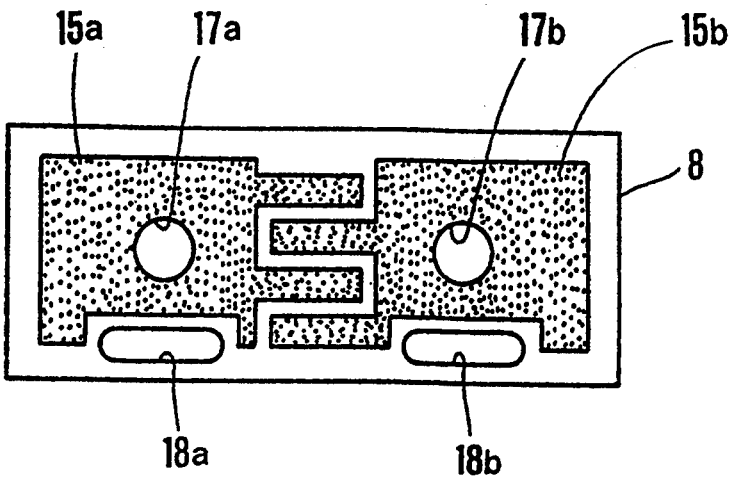
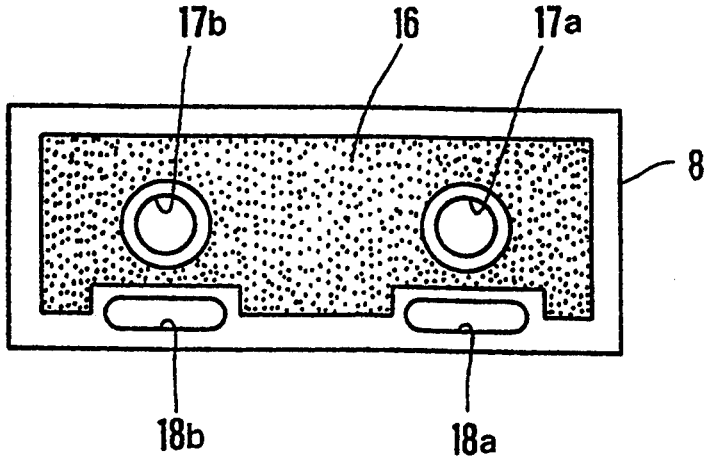
FIG. 3B

FIG. 7A
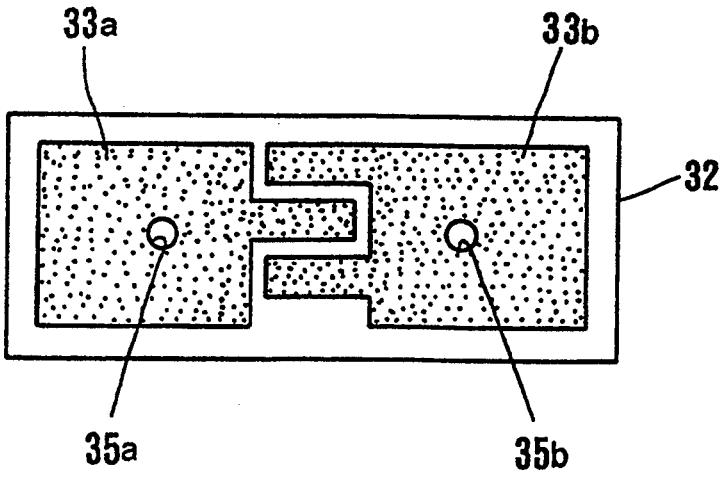
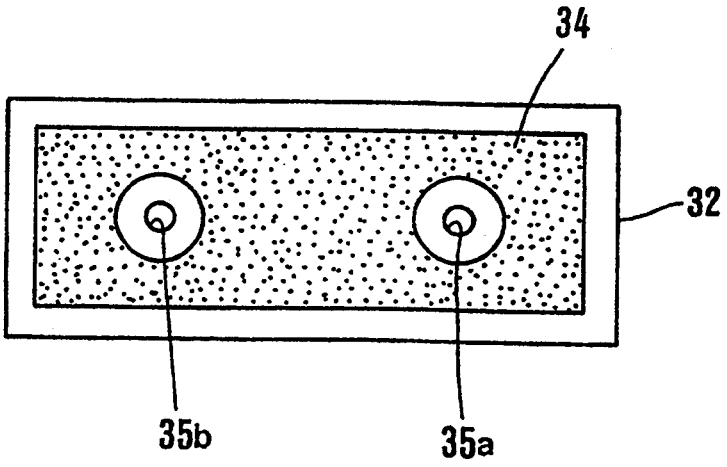
FIG. 7B

DIELECTRIC FILTER DEVICE

BACKGROUND OF THE INVENTION

The present invention relates to a dielectric filter device having a plurality of juxtaposed coaxial dielectric resonators.

An example of a conventional dielectric filter device of this kind is disclosed in Japanese Patent Kokai No. 3-136502 in which the dielectric filter device comprises a plurality of juxtaposed coaxial dielectric resonators, each of the dielectric resonators includes an outer conductive layer provided on its outer surface except its front surface and an axially extended bore whose inner surface is coated with an inner conductive layer. Each dielectric resonator is covered with a printed-circuit board with which a plurality of conductors having a predetermined pattern are connected so as to form a capacitor circuit which generates a coupling capacitance. Each conductor is connected with the inner conductive layer of the associated coaxial resonator. Input and output terminals are connected with the inner conductive layers of the outermost positioned coaxial resonators with which capacitors may be externally connected to maintain input and output capacities. Also, in order to adjust a frequency response of the filter device and reduce the length of each resonator stray capacities may be provided. In that case a capacitor is connected between the inner conductive layer of each coaxial resonator and a ground terminal.

However, such a conventional filter device has disadvantages that the arrangement becomes complicated and is bulky because the input and output coupling capacities and the couping between the resonators are made by the same dielectric substrate and it is necessary to provide elements to be externally mounted other than the printed-circuit board for ensuring the required capacities and the stray capacities. Also it is difficult or substantially impossible to set and adjust the capacities after the filter is assembled.

Japanese Patent Kokai No. 61-156903 discloses another conventional filter device which comprises a plurality of juxtaposed coaxial dielectric resonators each including an axially extended bore whose inner surface is provided with an inner conductive layer, a connecting terminal having one end inserted into the bore and connected with the inner conductive layer and other end extended from the front surface, and an outer conductive layer provided on the intended portion of the outer surface. Each resonator is constructed by superimposing two dielectric block halves divided longitudinally in such a manner that bore halves provided in them are opposite so as to complete the bore.

With the arrangement disclosed in this reference, it is essential that lead wires should be connected with the inner conductive layers positioned at both the outermost coaxial dielectric resonators of the filter by soldering or the like. Therefore, lead wire guiding holes should be provided on both side portions of the dielectric block halves in a direction orthogonal to the axis of the bore halves. Each lead wire is guided outwardly through the corresponding hole. The guiding holes are given an enough inner dimension to prevent the thickness of the lead wires or any solder from obstructing the jointing of the dielectric block halves. However, to form the block halves with such lead wire guiding holes a complicated mold must be prepared, which results in that not only the forming of the block halves is costly, but also the block halves is weakened because of the present of lead wire guiding holes.

SUMMARY OF THE INVENTION

It is therefore an object of the present invention to provide a simplified dielectric filter device capable of easily adjusting a frquency response characteristic.

Another object of the present invention is to provide a dielectric filter device having no lead wire connection.

According to a first aspect of the present invention, there is provided a dielectric filter device comprising:

at least two coaxial dielectric resonator bodies juxtaposed to each other, each including an outer conductive layer provided on an outer surface except a front surface thereof and an axially extended through bore which has an inner surface provided with an inner conductive layer;

a first dielectric substrate intended to be disposed on the front surfaces of the juxtaposed coaxial dielectric resonator bodies and having input and output conductors on its inner surface and connecting conductors on its outer surface for forming input and output capacities therebetween;

a second dielectric substrate superimposed on the first dielectric substrate and having a plurality of conductors arranged on its inner surface corresponding to the resonator bodies and capacitively coupled to each other for forming a coupling capacity and a ground conductor arranged on its outer surface opposite to the conductors on the inner surface thereof for forming stray capacities; and means for connecting the connecting conductors on the outer surface of the first dielectric substrate and the capacitively coupled conductors on the inner surface of the second dielectric substrate with the inner conductive layers on both the outermost resonator bodies.

Each of the connecting means may comprise a plug member which has one end inserted into the bore of the associated resonator body and connected with the inner conductive layer and the other end extended outwardly from a front surface of said resonator body.

The first and second dielectric substrates may be provided with holes for receiving the outwardly extended ends of the respective plug members.

With the filter device of the first aspect of the present invention, the inner conductive layers in both the outermost coaxial resonator bodies are electrically connected with the corresponding connecting conductors on the outer surface of the first dielectric substrate through the associated connecting means. The input and output capacities are formed between the input conductor and the corresponding connecting conductor and between the output conductor and the corresponding connecting conductor on the first dielectric substrate, respectively and then are connected with input and output terminals, respectively.

The inner conductive layer in each coaxial dielectric resonator body is connected with the associated one of the capacitive coupled conductors. By capacitive coupling between the capacitively coupled conductors the coupling capacity is formed. The stray capacities are formed between the respective conductors and the ground conductor on the second dielectric substrate.

Each of the capacitively coupled conductors may be connected through the connecting conductor with the corresponding connecting means through which each of the capacitively coupled conductors may be connected with the inner conductive layer in the associated resonator body.

According to a second aspect of the present invention, there is provided a dielectric filter device comprising at least two juxtaposed coaxial dielectric resonator bodies each of which is constructed by stacking two longitudinally divided dielectric block halves to each other so that the inner surfaces thereof are joined to each other, each of the halves having an outer conductive layer provided on an outer surface except a front surface thereof and a longitudinally extended groove on the inner surface thereof, each of the longitudinally extended grooves being provided with an inner conductive layer on its inner surface and being put together to form an axially extended through bore into which a connecting member is fitted, the inner conductive layers of both the outermost resonator bodies being laterally and outwardly extended along the joined inner surfaces of the dielectric block halves while insulated from the outer conductive layer to form input and output terminals.

According to a third aspect of the present invention, there is provided a dielectric filter device comprising:

at least two coaxial dielectric resonator bodies juxtaposed to each other, each including an outer conductive layer provided on an outer surface except a front surface thereof and an axially extended through bore which has an inner surface provided with an inner conductive layer which is connected with an outwardly extending connector member; and a dielectric substrate disposed on the front surfaces of the juxtaposed resonator bodies and having a plurality of conductors arranged on its inner surface corresponding to the resonator bodies and capacitively coupled to each other for forming a coupling capacity and a ground conductor arranged on its outer surface opposite to the conductors on the inner surface thereof for forming stray capacities.

Preferably, each of the resonator bodies may be constructed by stacking two longitudinally divided dielectric block halves having longitudinally extended grooves on their inner surfaces to each other so that the inner surfaces thereof are joined to each other, and the inner conductive layers of both the outermost resonator bodies may be outwardly extended along the joined inner surfaces of the dielectric block halves while kept insulated from the outer conductive layer to form input and output terminals.

Also, the dielectric substrate may be provided with holes for receiving the outwardly extended ends of the respective connector members.

Each of the outwardly extended portions of the inner conducting layers in both the outermost resonator bodies has one or an inner end connected with the inner conductive layer and the other or outer end extended outwardly, and then is connected with an associated outer conductor wire.

In the arrangements according to the present invention, by the provision of the stray capacities the piezoelectric resonator bodies can be shortened in length. When being assembled the filter device has the exposed ground conductor. Therefore, the stray capacities can be decreased by partially removing the exposed ground conductor to raise the resonance frequency. To the contrary, by providing an additional conductor on the outer surface the stray capacities can be increased to lower the resonance frequency. Furthermore, the quantity of the coupling can be controlled by removing the portion of the ground conductor which is opposite to the capacitive connection of the capacitively coupled conductors.

The present invention will now be described by way of example with reference to the accompanying drawings:

BRIEF DESCRIPTION OF THE DRAWINGS

FIGS. 2A and 2B are plan views of a first dielectric substrate used in the dielectric filter device of FIG. 1, showing inner and outer surfaces thereof, respectively;

FIGS. 3A and 3B are plan views of a second dielectric substrate used in the dielectric filter device of FIG. 1, showing inner and outer surfaces thereof, respectively;

FIGS. 7A and 7B are plan views of a dielectric substrate used in the dielectric filter device of FIG. 6, showing inner and outer surfaces thereof, respectively;

DETAILED DESCRIPTION

Figure 1:
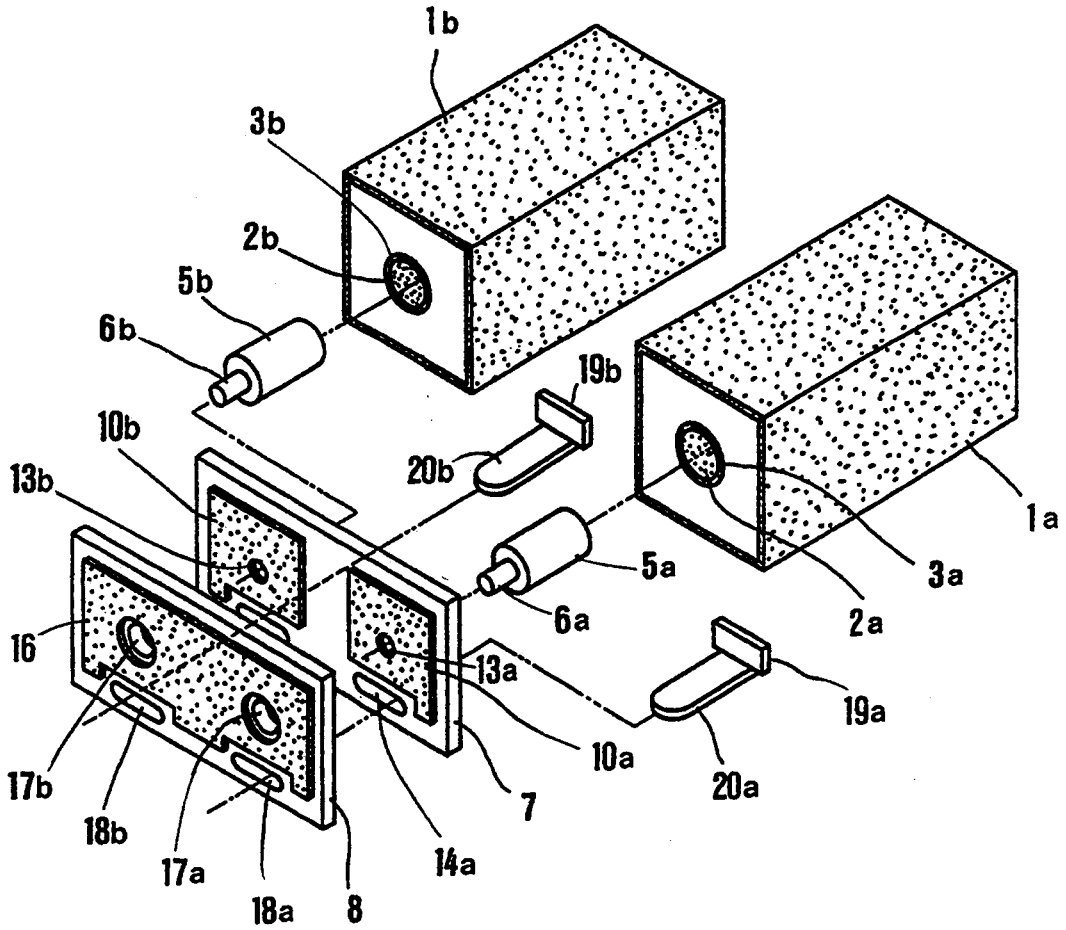
FIG. 1 is an exploded perspective view of a dielectric filter device according to one embodiment of the present invention.

Referring to FIGS. 1 to 4, there is shown a dielectric filter device according to an embodiment of the present invention. The illustrated filter device comprises two juxtaposed dielectric coaxial resonator bodies 1*a* and 1*b* each of which is made of titanium oxide dielectric ceramic material and is shaped as a rectangular parallelepiped. The resonator bodies 1*a* and 1*b* have through bores 2*a* and 2*b*, respectively, each of which extends from the front end to rear end along the center axes thereof. Each of the through bores 2*a* and 2*b* has an inner surface provided with an inner conductive layer 3*a* or 3*b*. Each of the resonator bodies 1*a* and 1*b* is provided with an outer conductive layer 4*a* or 4*b* on the outer surface except the front surface thereof. Reference numerals 5*a* and 5*b* represent connecting plug members of metal each of which has one end securely fitted into the front end portion of the bore 2*a* or 2*b* to ensure the electric connection thereof with inner conductive layer 3*a* or 3*b* and the other end or front end 6*a* or 6*b* of reduced diameter extended outwardly from the front surface of the associated resonator body 1*a* or 1*b*.

A first and second dielectric substrates 7 and 8 are superimposed to each other and are disposed over the front surfaces of the resonator bodies 1*a* and 1*b*. These dielectric substrates are made of dielectric ceramic material.

The first dielectric substrate 7 has an inside surface on which as shown in FIG. 2A an input and output conductors 9*a* and 9*b* (or 9*b* and 9*a*) are formed opposite to the coaxial resonator bodies 1*a* and 1*b*, respectively and an outside surface on which as shown in FIG. 2B connecting conductors 10*a* and 10*b* are formed opposite to the input and output conductors.

Fitting holes 13*a* and 13*b* are provided to be extended through the input or output conductor, the first dielectric substrate 7 and the connecting conductor for inserting the front ends 6*a* and 6*b* of the connecting plug members 5*a* and 5*b*, respectively.

Figure 4:
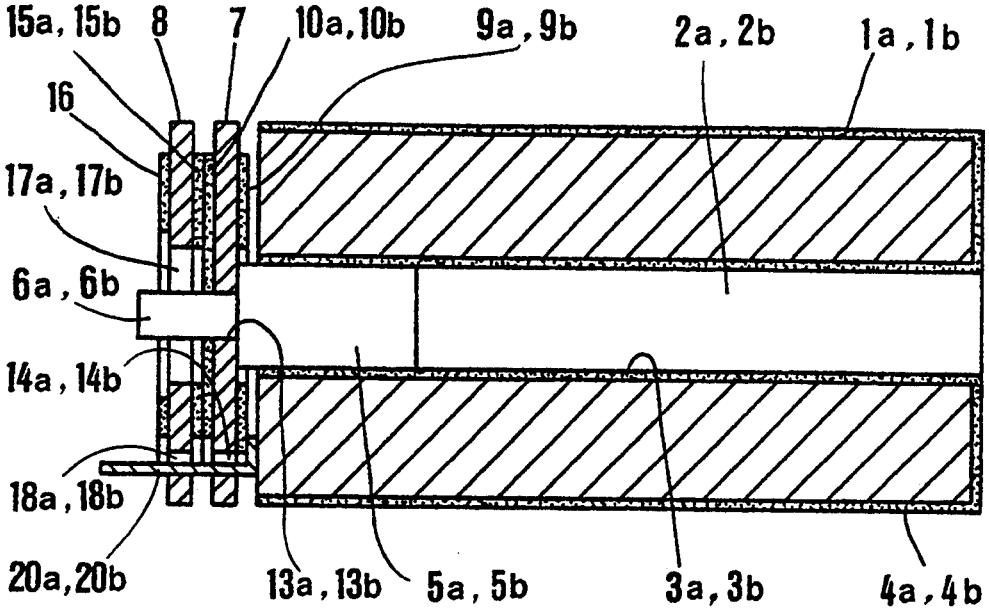
FIG. 4 is a schematic longitudinal section of the dielectric filter device of FIG. 1 taken along the center axis of one of the dielectric resonators.

The input and output conductors 9*a* and 9*b* (or 9*b* and 9*a*) are partially removed at the edge portions of the fitting holes 13*a* and 13*b* so that they are not connected with the inserted connecting plug members 5*a* and 5*b* as shown in FIGS. 2A and 4. The connecting conductors 10*a* and 10*b* are spread to the edge portion of the fitting holes 13*a* and 13*b* so that they are connected with the front ends 6*a* and 6*b* of the inserted connecting plug members 5*a* and 5*b* as shown in FIGS. 2B and 4.

The first dielectric substrate 7 is also provided with two slots 14*a* and 14*b* at the positions where they do not come into contact with the connecting conductors 10*a* and 10*b*.

The second dielectric substrate 8 has an inside surface on which as shown in FIG. 3A conductors 15*a* and 15*b* having an interdigitated pattern are so formed that they come into contact with the connecting conductors 10*a* and 10*b*, respectively, when the first and second dielectric substrates 7 and 8 are superimposed to each other. The interdigitated portions of both the conductors 15*a* and 15*b* form a capacitive coupling. On the outside surface of the second dielectric substrate 8, as shown in FIG. 3B, a ground conductor 16 is formed opposite to the conductors 15*a* and 15*b*.

Fitting holes 17*a* and 17*b* are provided to be extended through the conductors 15*a* and 15*b*, the second dielectric substrate 8 and the ground conductor 16 for inserting the front ends 6*a* and 6*b* of the connecting plug members 5*a* and 5*b*, respectively.

The ground conductor 16 is partially removed at the edge portions of the fitting holes 17*a* and 17*b* so that it is not connected with the inserted connecting plug members 5*a* and 5*b* as shown in FIG. 4. The conductors 15*a* and 15*b* are connected through the connecting conductors 10*a* and 10*b* on the first dielectric substrate 7 with the respective connecting plug members 5*a* and 5*b* and thus the inner conductive layers 3*a* and 3*b* in the resonator bodies 1*a* and 1*b*. Alternatively, the conductors 15*a* and 15*b* may be arranged so that they are directly connected with the respective connecting plug members 5*a* and 5*b*.

Also, the second dielectric substrate 8 is provided with slots 18*a* and 18*b* at the positions where they do not come into contact with the conductors 15*a* and 15*b* but are aligned with the slots 14*a* and 14*b* in the first dielectric substrate 7.

Terminal plates 19*a* and 19*b* are brought into contact with the input and output conductors 9*a* and 9*b* (or 9*b* and 9*a*) on the first substrate 7. The terminal plates 19*a* and 19*b* have connecting legs 20*a* and 20*b* which are inserted into the slots 14*a* and 18*a*; 14*b* and 18*b* in the first and second substrates 7 and 8, and are connected with an external input and output conductor lines on a printed-circuit board (not shown), thereby connecting the input and output conductors 9*a* and 9*b* with the external input and output conductor lines, respectively. Also, the ground conductor 16 is grounded via a casing or the like not shown.

When the first and second dielectric substrates 7 and 8 are superimposed to each other and mounted on the front portion of the juxtaposed resonator bodies 1*a* and 1*b*, the inner conductive layers 3*a* and 3*b* in the resonator bodies 1*a* and 1*b* are electrically connected via the connecting plug members 5*a* and 5*b* with the connecting conductors 10*a* and 10*b* on the outside surface of the first dielectric substrate 7. Each of the input and output conductors 9*a* and 9*b* and the corresponding connecting conductor 10*a* or 10*b* between which the first dielectric substrate 7 is sandwiched form an input and output capacities C1 and C2, respectively as shown in the equivalent circuit of FIG. 5. The input and output capacities C1 and C2 are connected via the terminal plates 19*a* and 19*b* with an external input and output terminals 21 and 22, respectively.

Figure 5:
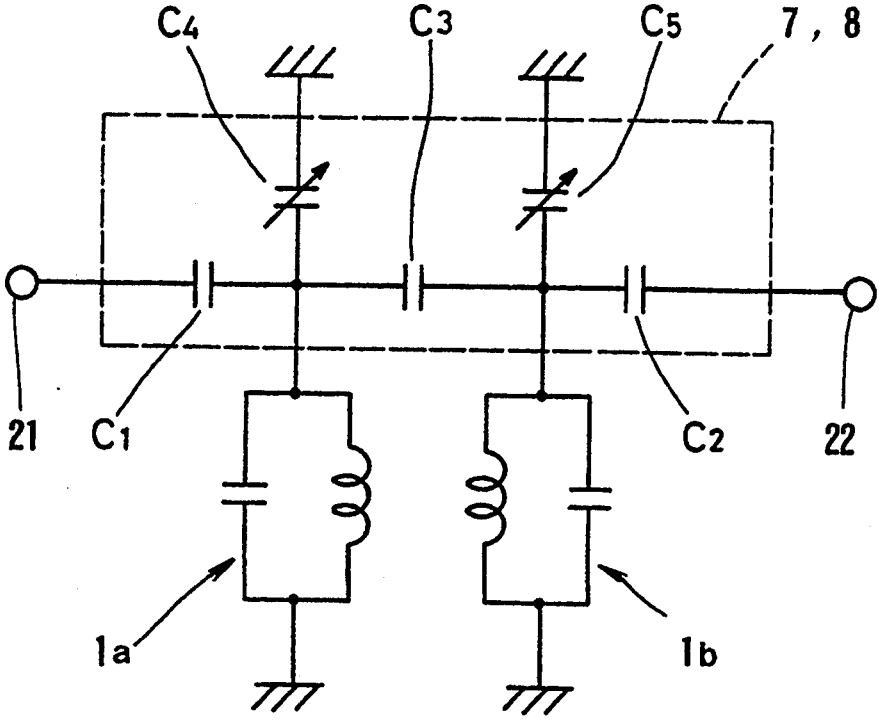
FIG. 5 is an equivalent circuit diagram of the dielectric filter device shown in FIG. 1.

The connecting conductors 10*a* and 10*b* are connected with the interdigitated conductors 15*a* and 15*b* whose capacitive coupling forms a coupling capacity C3 (FIG. 5).

Each of the interdigitated conductors 15*a* and 15*b* and the ground conductor 16 between which the second dielectric substrate 8 is sandwiched form stray capacities C4 and C5, respectively as shown in the equivalent circuit of FIG. 5. These stray capacities C4 and C5 are grounded via the ground conductor 16.

In this embodiment the filter device comprises two coaxial resonator bodies. However the filter device may be constructed by using three or more coaxial resonator bodies juxtaposed. In that case, the input and output conductors on the inside surface of the first dielectric substrate should be positioned so that they are correspondent to both the outermost coaxial resonator bodies. Opposite to the thus positioned input and output conductors, the connecting conductors should also be arranged on the outer surface of the first dielectric substrate so as to form the input and output capacities C1 and C2. On the inside surface of the second dielectric substrate there should be arranged the conductors of the same number as the resonator bodies used for forming coupling capacities.

Figure 6:
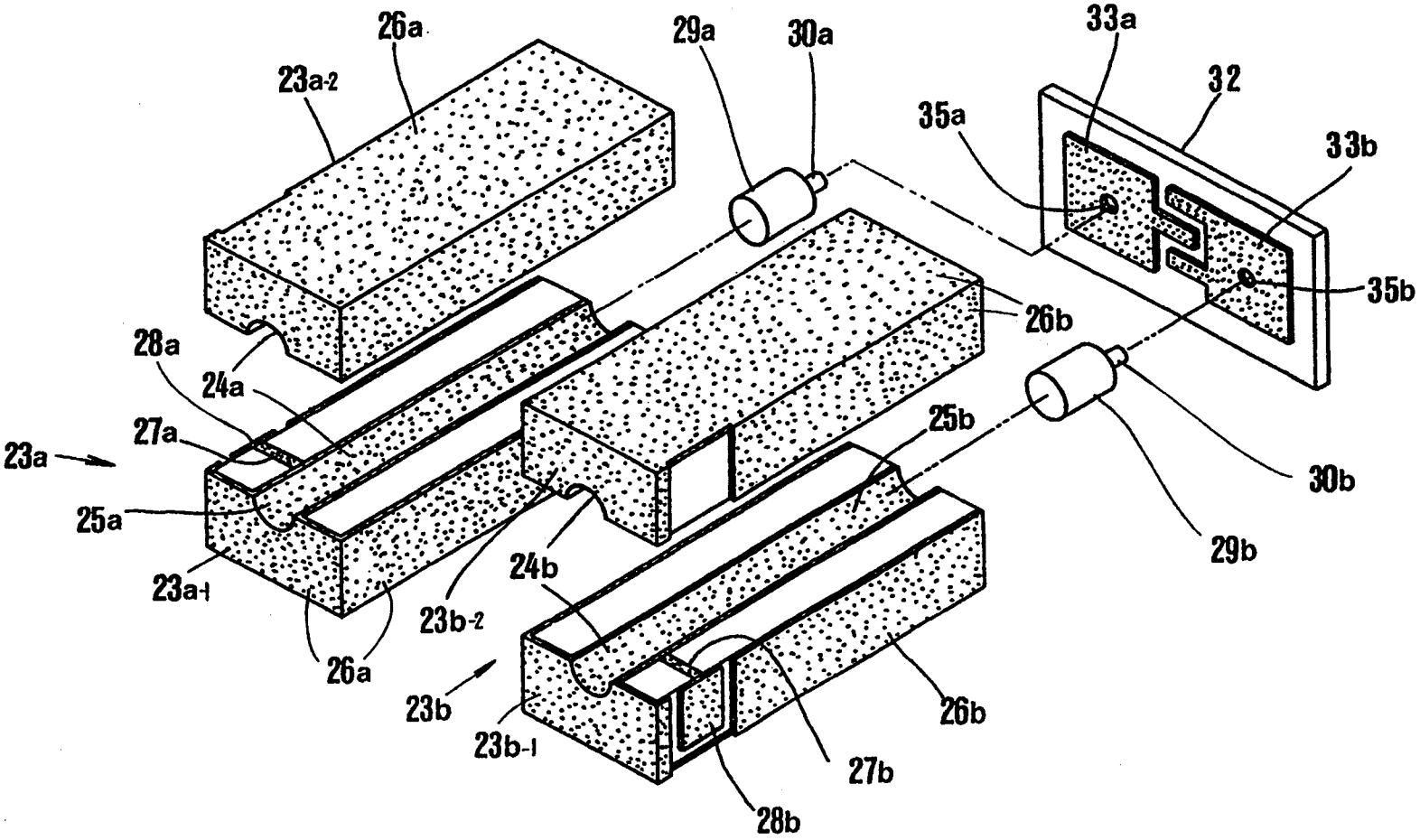
FIG. 6 is an exploded perspective view of a dielectric filter device according to another embodiment of the present invention.

FIGS. 6 to 9 illustrate another embodiment of the present invention, in which the illustrated filter device comprises two juxtaposed coaxial dielectric resonator bodies 23*a* and 23*b*. Each resonator body is made of titanium oxide dielectric ceramic material, is shaped as a rectangular parallelepiped and is constructed by superimposing two sections longitudinally divided as halves 23*a*-1 and 23*a*-2; 23*b*-1 and 23*b*-2 to each other. The halves have inner surfaces which are to be superimposed to each other. On each of the inner surfaces a longitudinally extended groove 24*a*; 24*b* of semi-circular cross section is formed. Coated on each groove 24*a*; 24*b* is an inner conductive layer 25*a*; 25*b*. These inner conductive layers 25*a* and 25*b* may be formed by using a screen printing or other suitable thin film forming procedures. An outer conductive layer 26*a*; 26*b* is formed on the outer surface of each of the halves except the inner and front surfaces thereof. Also, as shown in FIG. 6, formed on the inner surface of one 23*a*-1; 23*b*-1 of the sections is a conductive connecting line 27*a*; 27*b* which is extending from the inner conductive layer 25*a*; 25*b* in the groove 24*a*; 24*b* to a rectangular input or output terminal 28*a*; 28*b* on the lateral surface of the section. These input and output terminals 28*a* and 28*b* (or 28*b* and 28*a*) may be provided by partially removing the outer conductive layer portions on the lateral surfaces of the respective sections so as to form rectangular portions electrically separated from the outer conductive layer. When the halves 23a-1 and 23a-2; 23b-1 and 23b-2 are assemblied to form the respective resonator body 23a; 23b, the semicircular grooves 24a and 24a; 24b and 24b form a through bore. Fitted into the thus formed through bores of the respective resonator bodies 23a and 23b are connecting plug members 29a and 29b of metal each of which has an outer end or front end 30a; 30b of reduced diameter extended outwardly from the front surface of the associated resonator body 23a; 23b.

Figure 8:
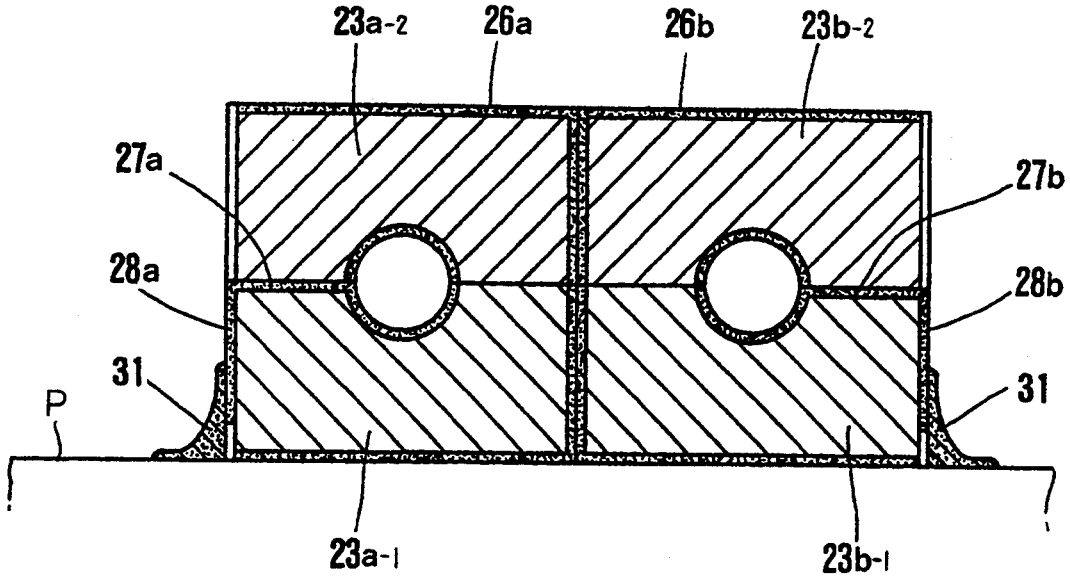
FIG. 8 is a schematic cross section of the dielectric filter device of FIG. 6 taken along the axis of the input and output terminals.

As shown in FIG. 8, the resonator bodies 23a and 23b are mounted on a printed circuit board P, and the input and output terminals 28a and 28b may be connected with intended conducting wires, not shown, on the board P by soldering generally designated by the reference numeral 31 without using any lead wire.

Disposed on the front surfaces of the juxtaposed resonator bodies 23a and 23b is a dielectric substrate 32 which is made of dielectric ceramic material.

The dielectric substrate 32 has an inside surface on which as shown in FIGS. 6 and 7A conductors 33a and 33b having an interdigitated pattern are so formed that they come into contact with the connecting plug members 29a and 29b , respectively, when dielectric substrate 32 is mounted on the front surfaces of the juxtaposed resonator bodies 23a and 23b. The interdigitated portions of both the conductors 33a and 33b form a capacitive coupling. On the outside surface of the dielectric substrate 32, as shown in FIG. 7B, a ground conductor 34 is formed opposite to the conductors 33a and 33b.

Fitting holes 35a and 35b are provided to be extended through the conductors 33a and 33b, the dielectric substrate 32 and the ground conductor 34 for inserting the front ends 30a and 30b of the connecting plug members 29a and 29b , respectively.

Figure 9:
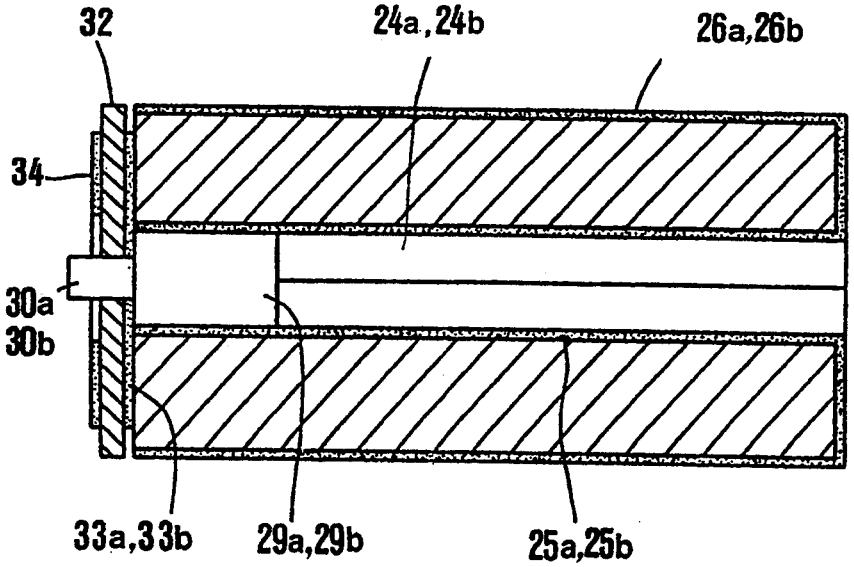
FIG. 9 is a schematic longitudinal section of the dielectric filter device of FIG. 6 taken along the center axis of one of the dielectric resonators.

The ground conductor 34 is partially removed at the edge portions of the fitting holes 17a and 17b so that it is not connected with the inserted connecting plug members 29a and 29b as shown in FIG. 9.

The input and output terminals 28a and 28b are connected with an external input and output conducting wires not shown, respectively, and the ground conductor 34 is grounded via a casing (not shown) or the like.

Figure 10:
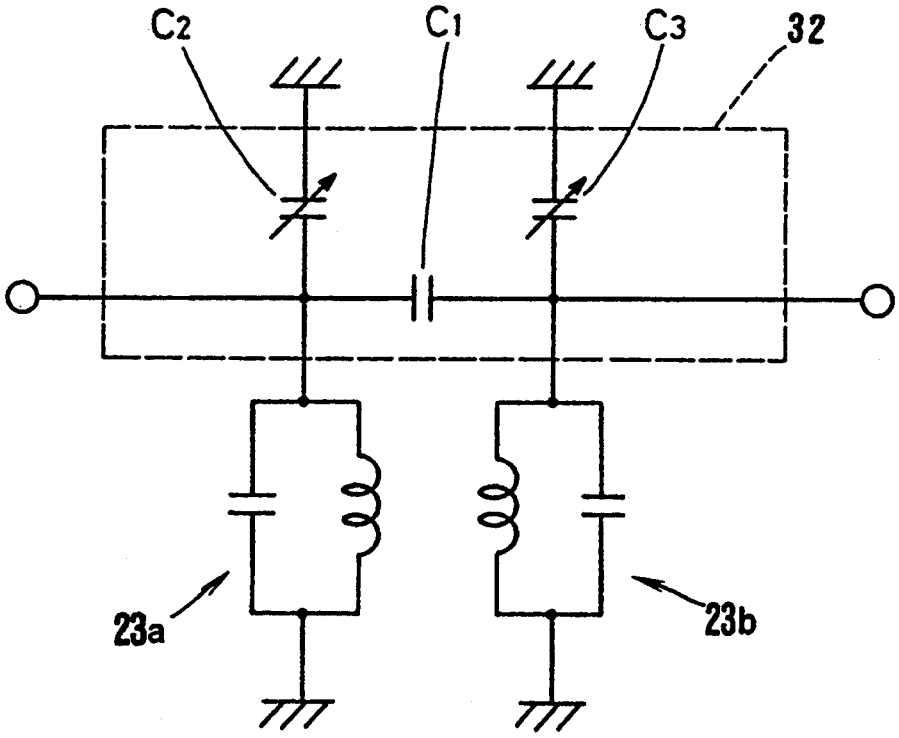
FIG. 10 is an equivalent circuit diagram of the dielectric filter device shown in FIG. 6.

The inner conductive layers 25a and 25b are connected with the conductors 33a and 33b, respectively. The capacitive coupling between the conductors 33a and 33b forms a coupling capacity C1 as shown in FIG. 10. The respective conductors 33a and 33b are opposite to the ground conductor 34 via the dielectric substrate 32 so as to form stray capacities C2 and C3 as shown in FIG. 10.

As in the case of the previous embodiment illustrated in FIGS. 1 to 4, the embodiment illustrated in FIGS. 6 to 9 may be modified as follows.

The filter device may include three or more coaxial resonator bodies juxtaposed, in which the input and output terminals are provided only on both the outermost resonator bodies. On the inside surface of the dielectric substrate there may be arranged the conductors of the same number as the resonator bodies used for forming coupling capacities.

As illustrated and described above, according to the present invention, by superimposing of two dielectric substrates it is possible to suitably set input and output capacities, a coupling capacity and stray capacities and thus no external capacitor is required, which results in a simplified arrangement. By the provision of the stray capacities each resonator body can be reduced in its length. By partially removing or adding the ground conductor, on the second dielectric substrate after assembling of the resonator bodies, the coupling capacity and stray capacities can be easily adjusted to obtain a desired frequency response characteristic. Therefore, the present invention can provide a dielectric filter device of reduced size having an excellent characteristic.

Furthermore, since both the outermost resonator bodies are provided with conductive connecting lines each of which has one end connected with the inner conductive layer in the through bore and the other end connected with the input or output terminal provided on the lateral surface of the associated resonator body, it is not necessary to use any complicated molds for producing the halves of the resonator body and to provide any lead wire guiding hole on the resonator body which reduces the mechanical strength thereof. Therefore, the filter device of the present invention has advantages that it can be easily prepared with lower cost and that it can be surface-mounted on the printed-circuit board.

It is to be understood that the above-mentioned embodiments are only illustrative of the application of the principles of the present invention. Numerous modifications and alterations may be made by those skilled in the art without departing from the spirit and scope of the invention, and the appended claims are intended to cover such modifications and alterations.

We claim:

1. A dielectric filter device comprising:

at least two coaxial dielectric resonator bodies juxtaposed to each other, each resonator body including an outer conductive layer provided on an outer surface except at a front surface thereof and an axially extended through bore which has an inner surface provided with an inner conductive layer;

a first dielectric substrate disposed on the front surfaces of the juxtaposed coaxial dielectric resonator bodies, the first dielectric substrate having respective input and output conductors on an inner surface thereof facing the front surfaces and respective connecting conductors on an outer surface opposite the inner surface thereof for forming input and output capacities therebetween;

a second dielectric substrate superimposed on the first dielectric substrate, the second dielectric substrate having a plurality of conductors arranged on an inner surface facing the front surfaces which are capacitively coupled to each other for forming a coupling capacity and a ground conductor arranged on an outer surface opposite to the inner surface thereof and hence opposite to the plurality of conductors on the inner surface thereof for forming stray capacities; and a respective connecting means for connecting the respective connecting conductors on the outer surface of the first dielectric substrate and the respective capacitively coupled conductors on the inner surface of the second dielectric substrate with the respective inner conductive layers on respective outermost ones of the at least two resonator bodies.

2. A dielectric filter device as claimed in claim 1, wherein each of said connecting means comprises a plug member which has one end inserted into the bore of the associated resonator body and connected with the inner conductive layer and which has the other end extended outwardly from the front surface of said resonator body.

3. A dielectric filter device as claimed in claim 2, wherein said first and second dielectric substrates are provided with holes for receiving the outwardly extended ends of the respective plug members.

4. A dielectric filter device comprising:

at least a first and a second juxtaposed coaxial dielectric resonator bodies, each resonator body being constructed by stacking two longitudinally divided dielectric block halves to each other so that inner surfaces of the block halves are joined to each other, each of the block halves having an outer conductive layer provided on an outer surface except at a front surface thereof and a longitudinally extended groove on the inner surface thereof, each of the longitudinally extended grooves being provided with an inner conductive layer on an inner surface and the joined block halves with the respective grooves of each block half thus forming an axially extended through bore;

a first terminal disposed on a lateral surface of the dielectric block half of the first dielectric resonator body, the first terminal being electrically isolated from the outer conductive layer on the lateral surface but electrically connected to the inner conductive layer of the longitudinally extended grooves in the first dielectric resonator body;

a second terminal disposed on a lateral surface of the dielectric block half of the second dielectric resonator body, the second terminal being electrically isolated from the outer conductive layer on the lateral surface but electrically connected to the inner conductive layer of the longitudinally extended grooves in the second dielectric resonator body;

a dielectric substrate disposed on the front surfaces of the juxtaposed resonator bodies, the dielectric substrate having a plurality of conductors on a first surface facing the front surfaces of the resonator bodies which plurality of conductors are capacitively coupled to each other for forming a coupling capacity, a ground conductor arranged on a second surface opposite to the first surface thereof and hence opposite to the plurality of conductors on the first surface thereof for forming stray capacities, and first and second holes therethrough; and a respective connecting means for connecting the respective conductors on the first surface of the dielectric substrate with the corresponding inner conductive layers, each of the connecting means comprising a plug member which has one end inserted into the bore of the associated resonator body and which one end is connected with the inner conductive layer, and which has another end received in the associated first or second holes of the dielectric substrate.

* * * * *